US009957132B2

(12) United States Patent
Berryhill

(10) Patent No.: US 9,957,132 B2
(45) Date of Patent: May 1, 2018

(54) ELEVATOR CONTROL SYSTEMS

(71) Applicants: ThyssenKrupp Elevator AG, Essen (DE); ThyssenKrupp AG, Essen (DE)

(72) Inventor: Jeff D. Berryhill, Essen (DE)

(73) Assignee: THYSSENKRUPP ELEVATOR AG, Essen (DE)

( * ) Notice: Subject to any disclaimer, the term of this patent is extended or adjusted under 35 U.S.C. 154(b) by 520 days.

(21) Appl. No.: 14/613,964

(22) Filed: Feb. 4, 2015

(65) Prior Publication Data

US 2016/0221791 A1 Aug. 4, 2016

(51) Int. Cl.

| | |
|---|---|
| ***B66B 1/18*** | (2006.01) |
| ***B66B 1/46*** | (2006.01) |
| ***B66B 1/24*** | (2006.01) |

(52) U.S. Cl.

CPC ..... *B66B 1/468* (2013.01); *B66B 1/2458* (2013.01); *B66B 2201/103* (2013.01); *B66B 2201/104* (2013.01); *B66B 2201/211* (2013.01); *B66B 2201/214* (2013.01); *B66B 2201/4653* (2013.01); *B66B 2201/4676* (2013.01)

(58) Field of Classification Search

CPC . B66B 1/468; B66B 1/2458; B66B 2201/103; B66B 2201/104; B66B 2201/211; B66B 2201/214; B66B 2201/4653; B66B 2201/4676

USPC ..... 187/247, 380–388, 391–393, 396

See application file for complete search history.

(56) References Cited

U.S. PATENT DOCUMENTS

| | | | | |
|---|---|---|---|---|
| 5,285,028 | A * | 2/1994 | Umeda | B66B 1/18 187/381 |
| 5,892,190 | A | 4/1999 | Morita et al. | |
| 6,425,460 | B2 * | 7/2002 | Schuster | B66B 1/34 187/247 |
| 6,868,945 | B2 * | 3/2005 | Schuster | B66B 1/468 187/380 |

(Continued)

FOREIGN PATENT DOCUMENTS

| | | |
|---|---|---|
| EP | 2149533 A1 | 2/2010 |
| WO | 2008040836 A1 | 4/2008 |

(Continued)

OTHER PUBLICATIONS

PCT Application No. PCT/EP2016/052059, International Search Report and Written Opinion, dated May 9, 2016, 11 pages.

*Primary Examiner* — Anthony Salata

(74) *Attorney, Agent, or Firm* — Lathrop Gage L.L.P.

(57) ABSTRACT

An elevator control system for controlling a plurality of elevators in an elevator bank includes a processor in communication with a non-transitory memory, and a networking device. The processor executes software instructions that cause the elevator control system to receive an elevator call placed by at least one of a user and a mobile device of the user. The elevator control system wirelessly communicates with the mobile device to determine an elevator criteria set by the user on the mobile device via an elevator control application. The elevator criteria comprises a preference and a requirement. The software instructions allow the processor to determine whether an elevator in the elevator bank meets the requirement and the preference, and an elevator that meets at least the requirement is automatically assigned to the user.

22 Claims, 14 Drawing Sheets

(56) References Cited

U.S. PATENT DOCUMENTS

| | | | | |
|---|---|---|---|---|
| 6,986,408 | B2 * | 1/2006 | Takeuchi | B66B 1/14 187/247 |
| 7,377,364 | B2 * | 5/2008 | Tyni | B66B 1/468 187/380 |
| 7,610,995 | B2 * | 11/2009 | Ylinen | B66B 1/34 187/381 |
| 8,020,672 | B2 * | 9/2011 | Lin | B66B 1/34 187/316 |
| 8,047,333 | B2 * | 11/2011 | Finschi | B66B 1/468 187/382 |
| 8,061,485 | B2 * | 11/2011 | Finschi | B66B 1/468 187/384 |
| 8,485,317 | B2 * | 7/2013 | Gerstenkorn | B66B 1/468 187/247 |
| 8,857,569 | B2 * | 10/2014 | Friedli | B66B 5/0012 187/384 |
| 8,880,200 | B2 * | 11/2014 | Nowel | B66B 1/468 187/247 |
| 9,139,401 | B2 * | 9/2015 | Finschi | B66B 1/2458 |
| 9,278,828 | B2 * | 3/2016 | Eto | B66B 1/2458 |
| 9,481,548 | B2 * | 11/2016 | Siddiqui | B66B 1/2416 |
| 2016/0031675 | A1 * | 2/2016 | Silvennoinen | B66B 1/468 187/247 |
| 2016/0214830 | A1 * | 7/2016 | Simcik | B66B 1/468 |

FOREIGN PATENT DOCUMENTS

| | | | |
|---|---|---|---|
| WO | 2008116963 | A1 | 10/2008 |
| WO | 2011102654 | A1 | 8/2011 |

* cited by examiner

304

304A

Enter your name 310: _____

Create a user name 312: _____

Enter your employer's name 314: _____

Which elevators is this profile 302 applicable to: _____

What is your intended floor 316A: _____; and your base floor 316B: _____

What is the device id number of your mobile device 126: _____

FIG. 6A

304

304A

Enter your name 310: Joe Johnson

Create a user name 312: Jjohnson

Enter your employer's name 314: Alpha Company

Which elevators is this profile 302 applicable to: Elevator Bank 10

What is your intended floor 316A: 12D ; and your base floor 316B: 12A

What is the device id number of your mobile device 126: AxF34

FIG. 6B

304

What is your time to destination criterion 318?
- ☐ 1 minute or less
- ☐ 2 minutes or less
- ☐ 3 minutes or less
- ☐ 4 minutes or less
- ☐ 5 minutes or less How many other passengers are you willing to ride the elevator with (the passenger maximum criterion 320)?
- ☐ 0
- ☐ 1 or fewer
- ☐ 2 or fewer
- ☐ 3 or fewer
- ☐ 4 or fewer
- ☐ 5 or fewer
- ☐ No preference Is the meeting of the passenger maximum criterion 320 a:
- ☐ Preference 306P
- ☐ Requirement 308R What is your door open time criterion 322?
- ☐ Standard
- ☐ Extended time Is the meeting of the door open time criterion 322 a:
- ☐ Preference 306P
- ☐ Requirement 308R Do you want to receive an alert 335 notifying you of the arrival of the elevator?
- ☐ Yes
- ☐ No Convey the alerts 334, 335 (elevator notification method criterion 324) by causing device 126 to:
- ☐ Vibrate
- ☐ Ring Would you like a SMS message 334B identifying your elevator and notifying you of the estimated time of arrival 334A of the elevator?
- ☐ Yes
- ☐ No Do you have a fragrance allergy 326A (the fragrance allergy criterion 326):
- ☐ Yes
- ☐ No Do you want to ride the elevator with certain individuals or a group of individuals (the friends criterion 330)?
- ☐ Yes ☐ No
- ☐ Preference 306P
- ☐ Requirement 308R Enter the user id of each such individual or group of individuals:

304B

Do you want to not ride the elevator with certain individuals or a group of individuals (the blocked user criterion 332)?
- ☐ Yes
- ☐ No Is the blocked user criterion 332 a preference or requirement?
- ☐ Preference 306P
- ☐ Requirement 308R Enter the user id of each such individual or group of individuals:

Do you want the acceleration and deceleration of your elevator to be (the acceleration-deceleration criterion 333):
- ☐ Standard
- ☐ Reduced Is the meeting of the acceleration-deceleration criterion 333 a:
- ☐ Preference
- ☐ Requirement Enter any additional criteria 336
1.
2.

FIG. 7A 317 304B

What is your time to destination criterion 318?
- [ ] 1 minute or less
- [x] 2 minutes or less
- [ ] 3 minutes or less
- [ ] 4 minutes or less
- [ ] 5 minutes or less How many other passengers are you willing to ride the elevator with (the passenger maximum criterion 320)?
- [ ] 0
- [ ] 1 or fewer
- [x] 2 or fewer
- [ ] 3 or fewer
- [ ] 4 or fewer
- [ ] 5 or fewer
- [ ] No preference Is the meeting of the passenger maximum criterion 320 a:
- [ ] Preference 306P
- [x] Requirement 308R What is your door open time criterion 322?
- [ ] Standard
- [x] Extended time Is the meeting of the door open time criterion 322 a:
- [ ] Preference 306P
- [x] Requirement 308R Do you want to receive an alert 335 notifying you of the arrival of the elevator?
- [x] Yes
- [ ] No To convey the alerts 334, 335, do you want the phone to:
- [x] Vibrate
- [x] Ring Would you like a SMS message 334B identifying your elevator and notifying you of the estimated time of arrival 334A of the elevator?
- [x] Yes
- [ ] No Do you have a fragrance allergy 326A (the fragrance allergy criterion 326):
- [ ] Yes
- [x] No Do you want to ride the elevator with certain individuals or a group of individuals (the friends criterion 330)?
- [x] Yes
- [ ] No
- [x] Preference 306P
- [ ] Requirement 308R Enter the user id of each such individual or group of individuals:
User 137
Group 137A (employees of Alpha Company)

Do you want to not ride the elevator with certain individuals or a group of individuals (the blocked user criterion 332)?
- [x] Yes
- [ ] No Is the blocked user criterion 332 a preference or requirement?
- [ ] Preference 306P
- [x] Requirement 308R Enter the user id of each such individual or group of individuals:
User 137C
Group 137B (employees of Beta Company 314B)

Do you want the acceleration and deceleration of your elevator to be (the acceleration-deceleration criterion 333):
- [ ] Standard
- [x] Reduced Is the meeting of the acceleration-deceleration criterion 33 a:
- [ ] Preference 306P
- [x] Requirement 308R Enter any additional criteria 336
1. Do not apply the profile 302 on Saturday and Sundays.

FIG. 7B

ELEVATOR CONTROL SYSTEMS

FIELD OF THE INVENTION

The invention relates generally to the field of elevator control systems. More specifically, the invention relates to elevator control systems that allow users to affect the assignment and operation of elevators via their respective mobile devices.

SUMMARY

Systems and methods for operating elevators are disclosed herein. According to an embodiment, an elevator control system for controlling a plurality of elevators in an elevator bank comprises a processor in communication with a non-transitory memory, and a networking device. Software instructions are provided and, when executed by the processor, perform steps for receiving an elevator call placed by at least one of a user and a mobile device of the user. The software instructions allow the control system to wirelessly communicate with the mobile device to determine an elevator criteria set by the user. The elevator criteria comprises a requirement and a preference. The elevator control system assigns an elevator to the user that meets at least the requirement, and wirelessly communicates an alert to the mobile device to notify the user of a status of the assigned elevator.

According to another embodiment, an elevator control system for controlling a plurality of elevators in an elevator bank comprises a processor in communication with a non-transitory memory, and a networking device. The processor executes software instructions that cause the elevator control system to receive an elevator call placed by at least one of a user and a mobile device of the user. The elevator control system wirelessly communicates with the mobile device to determine an elevator criteria set by the user on the mobile device via an elevator control application. The elevator criteria comprises a preference and a requirement. The software instructions allow the processor to determine whether an elevator in the elevator bank meets the requirement and the preference, and an elevator that meets at least the requirement is automatically assigned to the user.

According to yet another embodiment, an elevator control system for operating a first elevator and a second elevator comprises a processor in communication with a non-transitory memory and a networking device. Software instructions are provided, and when executed by the processor, perform steps for receiving an elevator call placed by at least one of a user and a mobile device of the user. The software instructions allow the control system to wirelessly communicate with the mobile device over a network to determine an elevator criteria set by the user. The elevator criteria comprising a requirement and a preference. The control system determines that the first elevator and the second elevator can each meet both the requirement and the preference, and assigns the first elevator to the user because it has a time to destination that is shorter than a time to destination of the second elevator.

BRIEF DESCRIPTION OF THE SEVERAL VIEWS OF THE DRAWINGS

Illustrative embodiments of the present invention are described in detail below with reference to the attached drawing figures and wherein:

FIGS. 6A and 6B are schematic illustrations of a user identification page of a mobile application associated with the elevator control system, according to an embodiment; and FIGS. 7A-7B are schematic illustrations of a preferences and requirements page of the mobile application of FIG. 6.

DETAILED DESCRIPTION

Elevators, which were once installed in a select few buildings, have now become ubiquitous. According to the National Elevator Industry, Inc., there are about a million elevator units in the United States, which are collectively used about eighteen billion times a year to transport one or more passengers from one floor to another. On average, an elevator unit transports about five passengers per trip. Each of these passengers may have certain unique preferences regarding their elevator rides. For example, one passenger may wish to board the next available elevator irrespective of how many other passengers are aboard, whereas another passenger, who may for example be claustrophobic, may wish to wait for an elevator that has no other (or less than two or three) passengers. Similarly, for instance, one passenger may wish to board that elevator which has the greatest acceleration and speed so that he may reach his destination as quickly as possible, whereas another passenger, who may for example be sensitive to and/or made ill by rapid accelerations and decelerations, may prefer to ride only that elevator which does not accelerate and decelerate rapidly. Generally, elevator control systems do not take the preferences of individual passengers into account, and in transporting the passengers, consider only one metric: operational efficiency. This causes undue discomfort to some passengers during their elevator rides, and precludes others from riding elevators altogether. The present invention is directed generally to elevator control systems that take the preferences of users into account in dispatching elevators and transporting the users via these elevators.

Figure 1A:
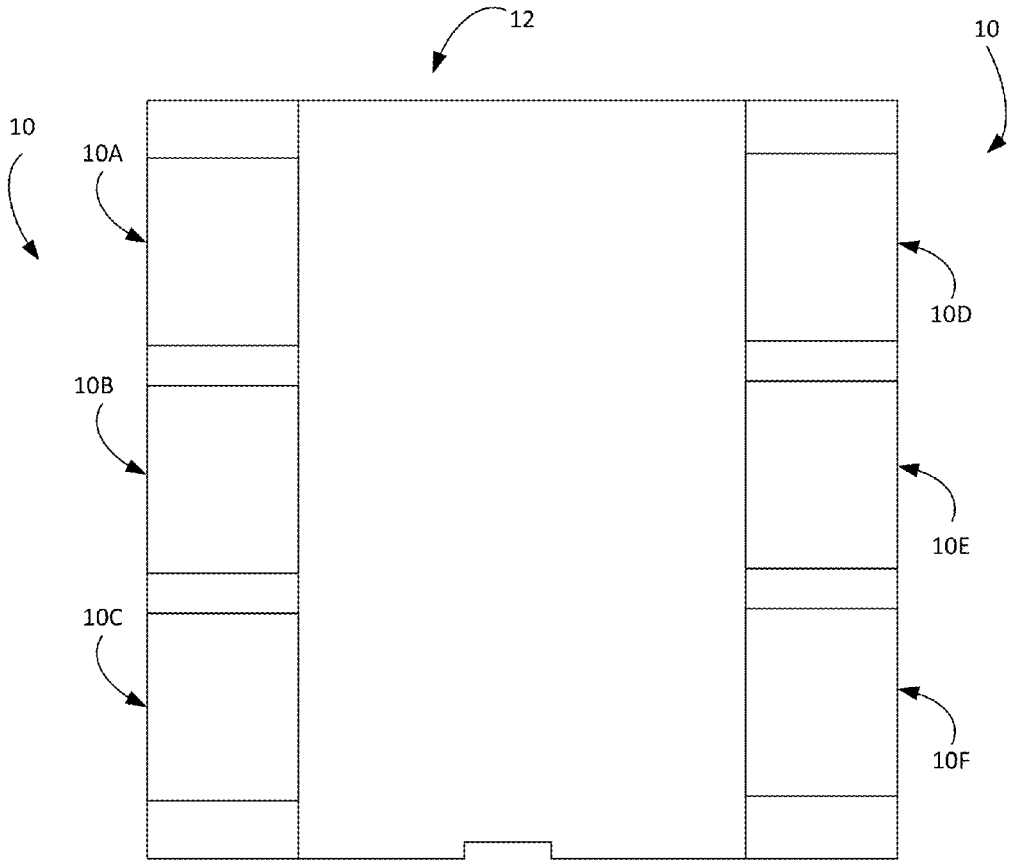
FIGS. 1A and 1B are cross-sectional views of a building with an elevator bank.
Figure 1B:
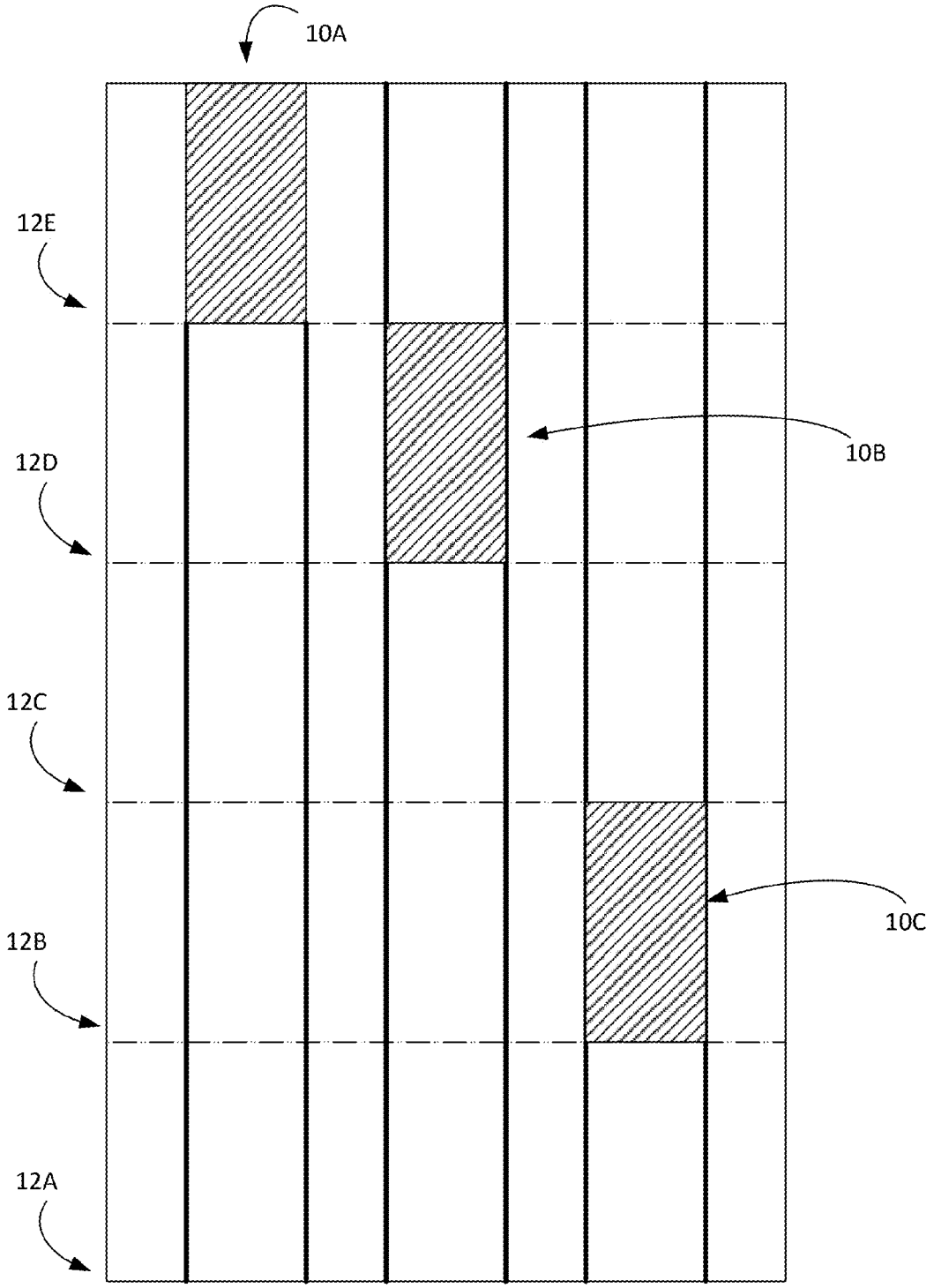

Attention is directed now to FIGS. 1A and 1B, which show an elevator bank 10 in an exemplary multi-story building 12. The elevator bank 10 has six elevators, identified in FIG. 1A as elevators 10A, 10B, 10C, 10D, 10E, and 10F, and the building 12 has five floors, referenced in FIG. 1B as floors 12A, 12B, 12C, 12D, and 12E. While various facets of the invention are disclosed herein with reference to the elevator bank 10 in the building 12, the skilled artisan will readily appreciate that the elevator bank 10 and the building 12 are merely exemplary and that the concepts disclosed herein are applicable to all elevators banks.

Figure 2:
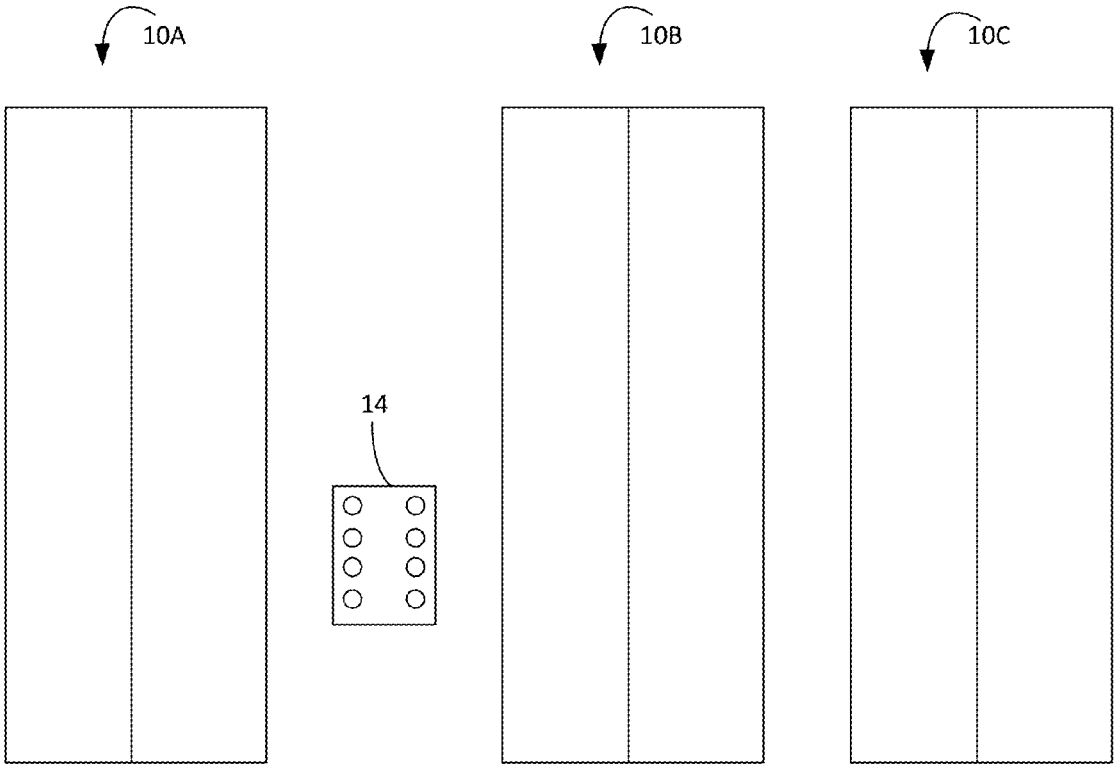
FIG. 2 is a perspective view of certain elevators of the elevator bank of FIGS. 1A-1B.
Figure 3:
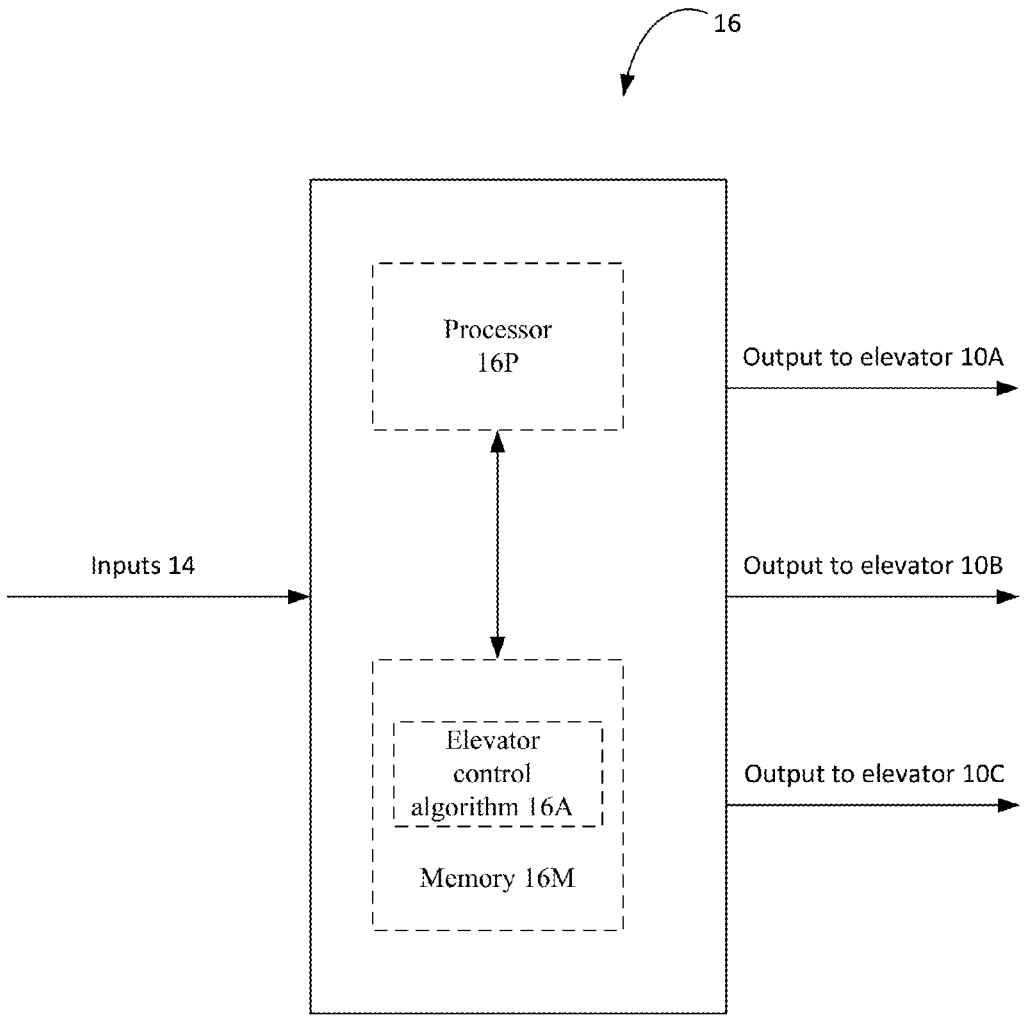
FIG. 3 PRIOR ART
FIG. 3 is a schematic illustration of a PRIOR ART elevator control system.

FIGS. 1B and 2 show the elevators 10A-10C, which may be generally identical to the elevators 10D-10F. The elevators 10A-10C may have input buttons 14 associated therewith, which may allow a user to call one of the elevators 10A-10C to his floor and respectively indicate the floor he intends to take an elevator to. In the prior art, a control system 16 (see FIG. 3), having a processor 16P and a computer memory 16M, may then implement an elevator control program or algorithm 16A to cause one of the elevators 10A-10C to travel to the floor 12B to pick up the user and transport him to the floor 12D.

The elevator control algorithm 16A may be simplistic, or highly sophisticated. Generally, different elevator manufacturers develop their own unique elevator control algorithms 16A in line with the requirements of the particular application. Some elevator control algorithms 16A, for example, generally categorized by the skilled artisans as the "nearest car" algorithms, may dispatch elevators based on a "figure of suitability", which takes into account the current direction of travel of the elevators (e.g., elevators 10A-10C), the distance between an elevator's current position and the floor of the user requesting the elevator, and optionally, the load of each elevator. Other elevator control algorithms, commonly referred to by the skilled artisans as "fixed sectoring" algorithms, divide the building into sectors, and in responding to an elevator call by a user, utilize preferably that elevator which is assigned to the sector from which the call is made. Other elevator control algorithms still, generally referred to by the skilled artisan as "dynamic sectoring algorithms", group the building's floors into dynamic sectors, allocate at least one elevator per dynamic sector that gives priority to elevator calls made from that sector, and adaptively modify the sector definitions based on various factors such as time of day, average loads, wait times, et cetera. Irrespective of the algorithm used, however, the goal of the elevator control algorithms 16A of the prior art is the same—to maximize operational efficiency (within the performance specifications). As discussed below, the elevator control algorithms disclosed herein also take into account the preferences of the various users. In so doing, the present invention, among other things, makes elevators accessible to people who heretofore were unable to ride them, and also makes elevator rides a more pleasant experience for all.

Figure 4A:
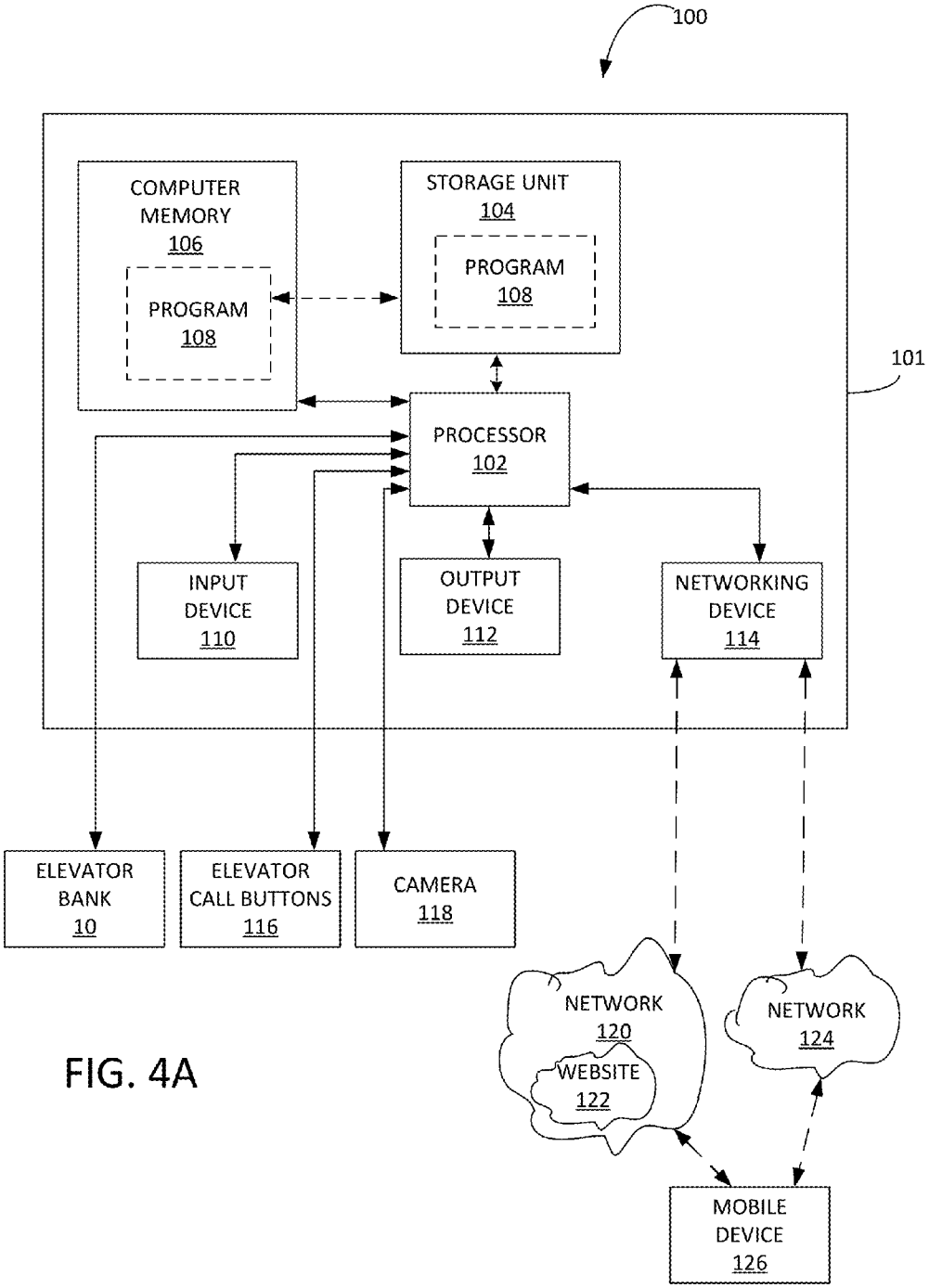
FIG. 4A is a schematic illustration of an elevator control system, according to an embodiment of the present invention.

Focus is directed now to FIG. 4A, which shows an elevator control (or elevator dispatch) system 100 in line with the teachings of the present invention. The elevator control system 100 may have an elevator controller 101 having a processor 102. The processor 102 may be in data communication with a storage unit 104, a computer memory 106, an input device 110, an output device 112, a networking device 114, elevator call buttons 116, and optionally, a camera 118, each of which are discussed in more detail below.

The storage unit 104 may be, for example, a disk drive that stores programs and data, and the storage unit 104 is illustratively shown storing a program 108 embodying the steps and methods set forth below. It should be understood that the program 108 could be broken into subprograms and stored in storage units of separate computers and that data could be transferred between those storage units using methods known in the art. A dashed outline within the computer memory 106 represents the software program 108 loaded into the computer memory 106 and a dashed line between the storage unit 104 and the computer memory 106 illustrates the transfer of the program 108 between the storage unit 104 and the computer memory 106.

The input device 110 may be any input device that allows for or facilitates the transfer of data to the control system 100. For example, the input device 110 may include one or more of a touch screen, an ID card reader, a keyboard, a mouse, a port (e.g., a USB port), a slot (e.g., an SD card slot), a switch, a knob, a biometric sensor (e.g., iris sensor, voice recognition sensor, or fingerprint scanner), and/or any other appropriate input device whether currently available or later developed. The output device 112 may similarly be any suitable device that allows the control system 100 (and more specifically, the processor 102) to output data, such as a touch screen display, an LCD or Plasma type display screen, a printer, a speaker, or any other appropriate visual and/or audible output device whether currently available or subsequently created.

The elevator call buttons 116 may be generally identical to the input buttons 14 (see FIG. 2), and allow a user to place a call for an elevator. As is known, one set of elevator call buttons 116 may allow a user to place a call for one of multiple elevators (e.g., elevators 10A, 10B, and 10C, or each of elevators 10A-10F). In some embodiments, the input device 110, the output device 112, and elevator call buttons 116 may comprise a single device (e.g., a touch screen).

The networking device 114 may be any device that allows the control system 100 to communicate over a network, such as networks 120 and 124. For example, the networking device 114 may be a router, a modem, a hub, a network interface card, a Bluetooth or RFID emitter and detector, et cetera. In some embodiments, the networking device 114 may allow the control system 100 to communicate over the networks 120 and/or 124 wirelessly. The networks 120 and 124, similarly, may be any type of network whether now available or later developed (e.g., Bluetooth, the Word Wide Web or Internet, Intranet, GSM, CDMA, RFID, et cetera). In one embodiment, as discussed herein, the network 120 may be a wireless Internet network that supports a website 122, and the network 124 may be a Bluetooth network. In other embodiments, the control system 100 may be able to communicate over only a solitary network (e.g., via Bluetooth).

The processor 102 may also be in data communication with the elevator bank 10 to allow the control system 100 to individually manage and control each of the elevators 10A-10F in the elevator bank 10. For example, the control system 100, via the processor 102, may be able to assign an elevator (e.g., any of elevators 10A-10F) to an elevator call, dispatch an elevator, control the speed of the ascent or descent of an elevator, control the amount of time for which the door of an elevator remains open to allow a user to enter or exit the elevator, et cetera. The various components traditionally used in elevator control mechanisms (e.g., programmable electric motors, pulleys (i.e., sheaves), steel cables, counter weights, timers, et cetera) are well known to those skilled in the art, and as such, are not discussed in detail herein.

In some embodiments, each elevator 10A-10F may include one or more cameras 118. In these embodiments, the program 108 may include facial recognition (or other suitable) software to allow the control system 100 to determine the identity of a user. The lens of the camera(s) 118 may be directed inside the elevator, towards the door of the elevator, or both. In some embodiments, the camera 118 may be placed outside the elevators 10A-10F (e.g., proximate the elevator call buttons 116). In other embodiments, the cameras 118 may be omitted.

In the elevator control system 100 shown in FIG. 4A, a solitary elevator controller 101 manages and controls the operation of each of the elevators 10A-10F in the elevator bank 10. The skilled artisan will understand, however, that this configuration is exemplary only. For example, in some embodiments, each elevator 10A-10F may have a separate elevator controller associated therewith to manage and control the operation of that elevator, and a master elevator controller in communication with each of the individual elevator controllers may be provided to determine which elevator 10A-10F to assign to an elevator call. In some of these embodiments, an elevator controller associated with one of the elevators 10A-10F may function as the master controller. As discussed in more detail below, a user may place an elevator call using the elevator call buttons 116, or wirelessly via the mobile device 126.

FIGS. 4B through 4F show alternate configurations of the elevator control system 100 for managing and controlling the operation of the elevators 10A-10F in the elevator bank 10. Elevator control systems 100B-100F shown respectively in FIGS. 4B through 4F may be substantially similar to the elevator control system 100 shown in FIG. 4A, except as specifically noted and/or shown, or as would be inherent. For uniformity and brevity, corresponding reference numbers may be used to indicate corresponding parts, though with any noted deviations.

Figure 4B:
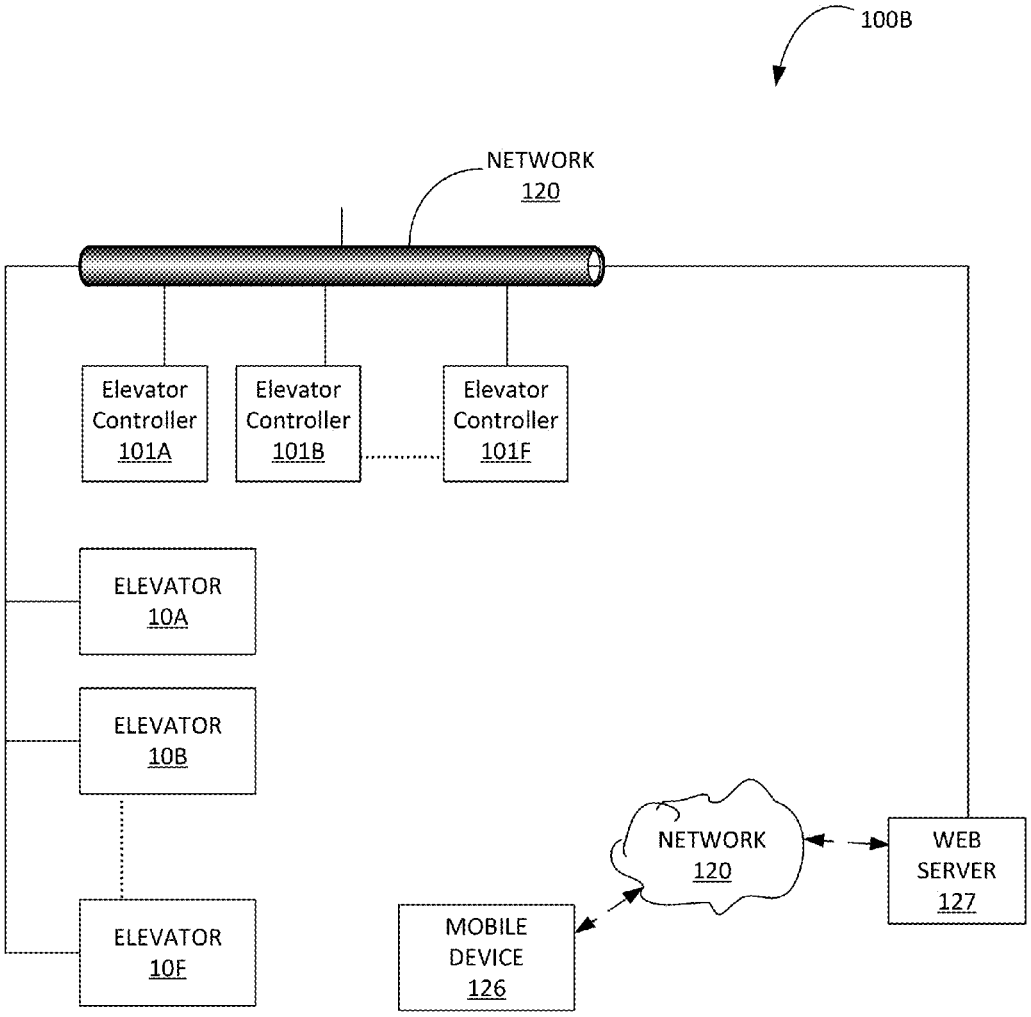
FIGS. 4B through 4F are schematic illustrations of alternate configurations of the elevator control system of FIG. 4A.

The elevator control system 100B, as shown in FIG. 4B, may comprise elevator controllers 101A through 101F, which may respectively manage and control the operation of the elevators 10A through 10F. As will be appreciated, each elevator controller 101A through 101F may have a processor, a storage unit, a networking device, and programming instructions stored in the storage unit to enable the elevator controller to manage and control the operation of the elevator associated with that controller. As can be seen, the elevator controllers 101A through 101F may each be in wired communication with a web server 127 over the network 120 (e.g., an internet or an intranet network). A user may use the mobile device 126 to communicate with the webserver 127 wirelessly over the network 120 (or alternatively or in addition, over the network 124 (e.g., a Bluetooth network, an RFID network, a WiFi network, et cetera)). As discussed in more detail below, a user may for example utilize the mobile device 126 to wirelessly place a call for an elevator over the network 120.

Figure 4C:
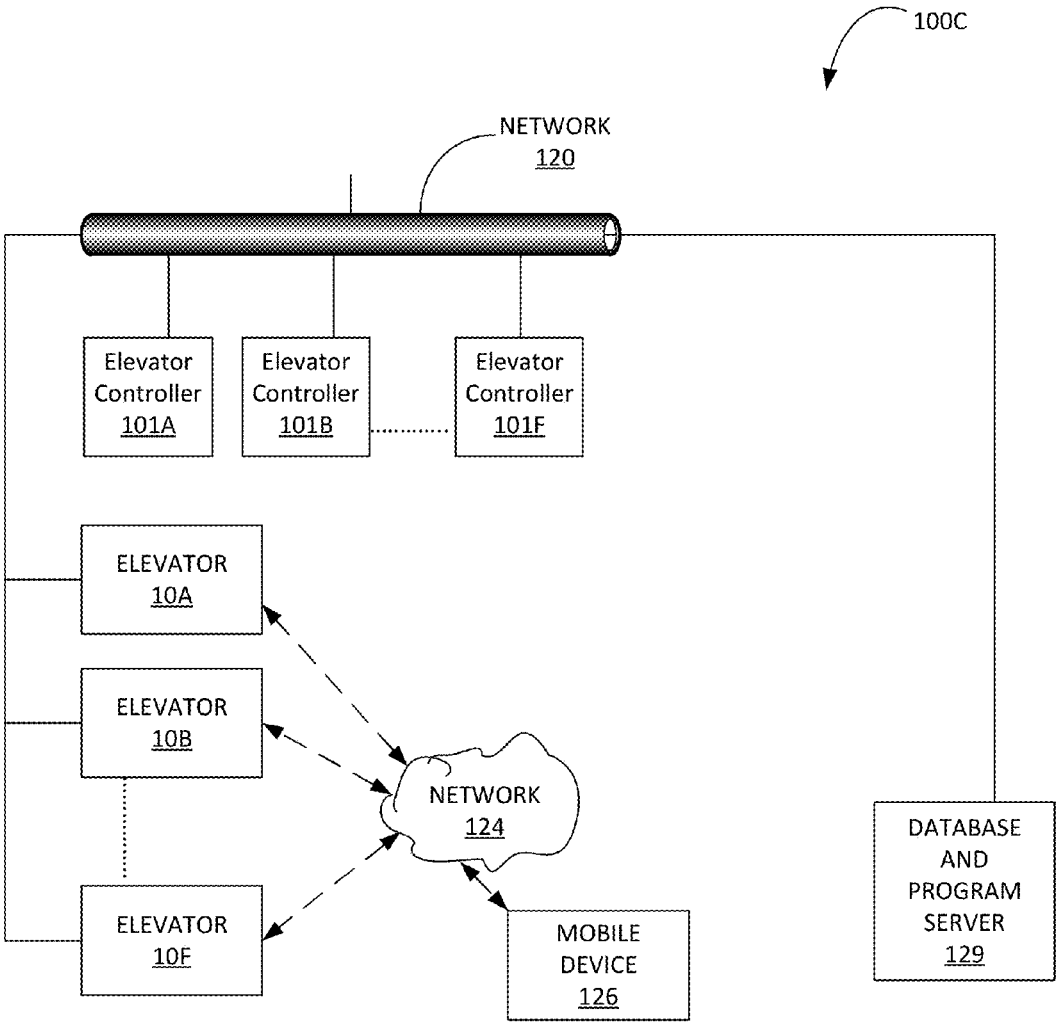

FIG. 4C shows the embodiment 100C of the elevator control system 100. As can be seen, in this embodiment 100C, a database and program server 129 may communicate over the network 120 with each of the elevator controllers 101A through 101F. Each elevator kiosk 10A through 10F may include a networking device which may allow a user to, via his mobile device 126, wirelessly communicate with the elevators 10A through 10F directly over the network 124 (e.g., a Bluetooth network, an RFID network, et cetera).

Figure 4D:
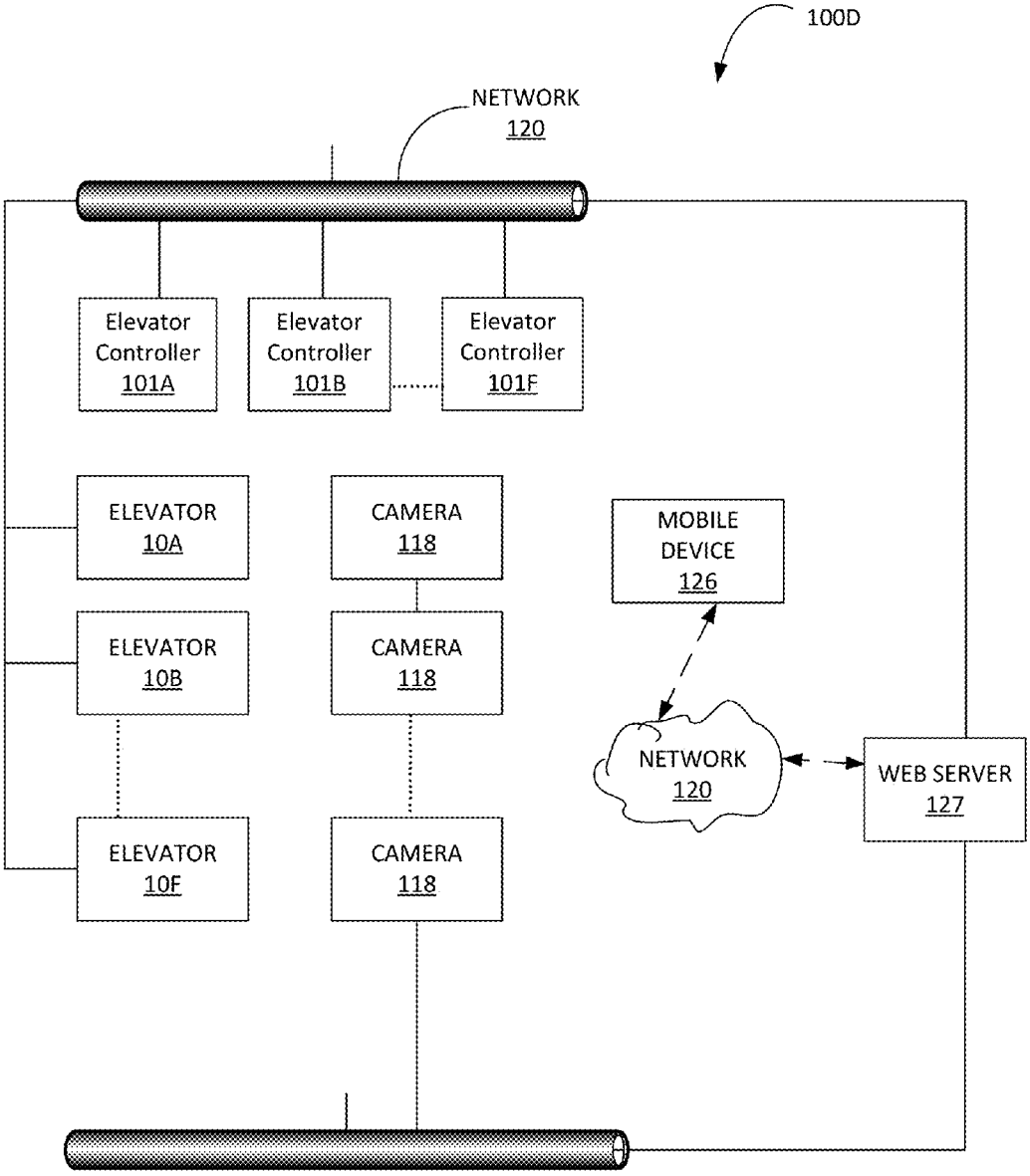

Other configurations are also contemplated. For example, as shown in FIG. 4D, the elevator control system 100D may comprise the web server 127, which may be in wired (or wireless) communication with each of the elevator controllers 101A through 101F over the network 120. And, akin to the embodiment 100B, a user may use the mobile device 126 to wirelessly communicate with the webserver 127 over the network 120 (or over the network 124). In this embodiment 100D, a camera (e.g., the camera 118) may be provided at each floor 12A through 12E, and each camera 118 may also communicate with the webserver 127 over the network 120 (e.g., using a wired connection or wirelessly). The camera 118 may be used to identify the user placing the elevator call, as discussed above and further below.

Figure 4E:
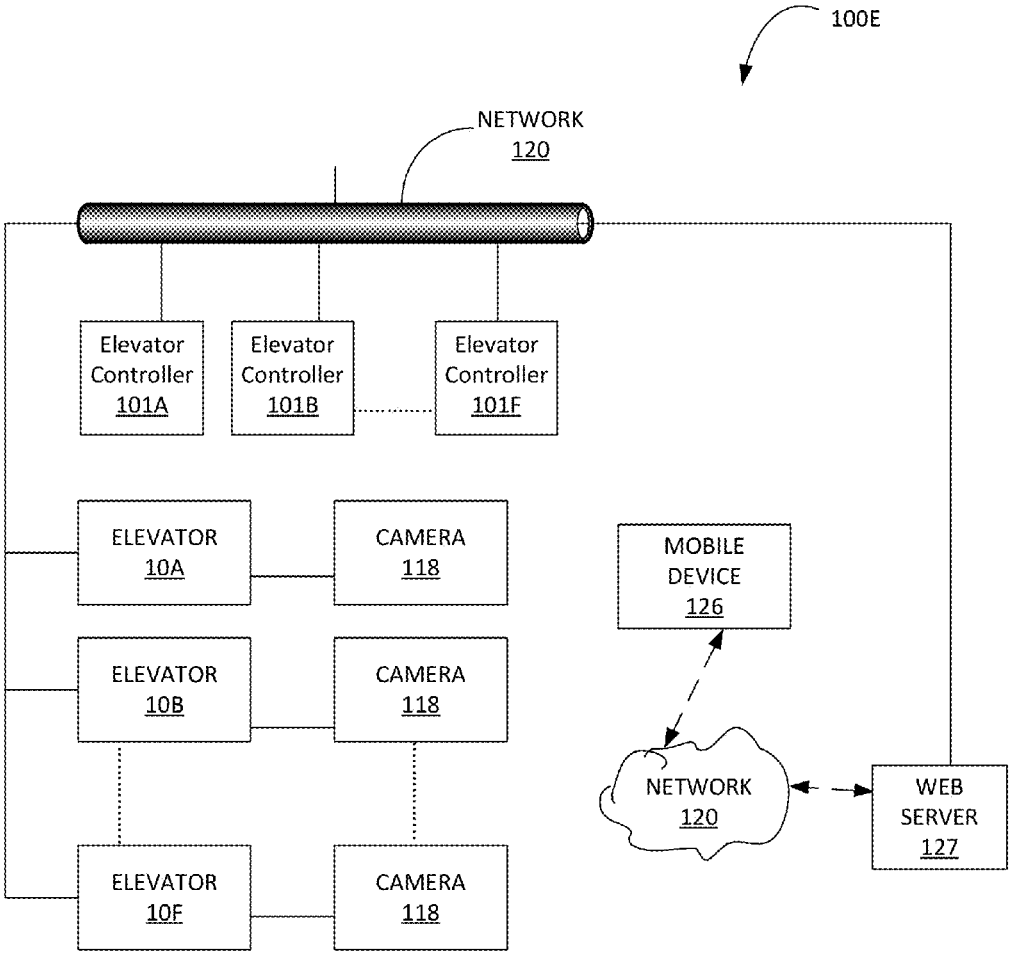

FIG. 4E shows the embodiment 100E of the elevator control system 100. The embodiment 100E is similar to the embodiment 100D, except that in this embodiment, the cameras 118, instead of being situated at the floors 12A-12E, are situated on the elevators 10A-10F. Each camera 118 may face the elevator door and/or the interior of the elevator. In some embodiments, multiple cameras 118 may be provided in each elevator kiosk 10A-10F. The cameras 118 may communicate with the elevator controllers 101A through 101F and the web server 127 over the network 120.

Figure 4F:
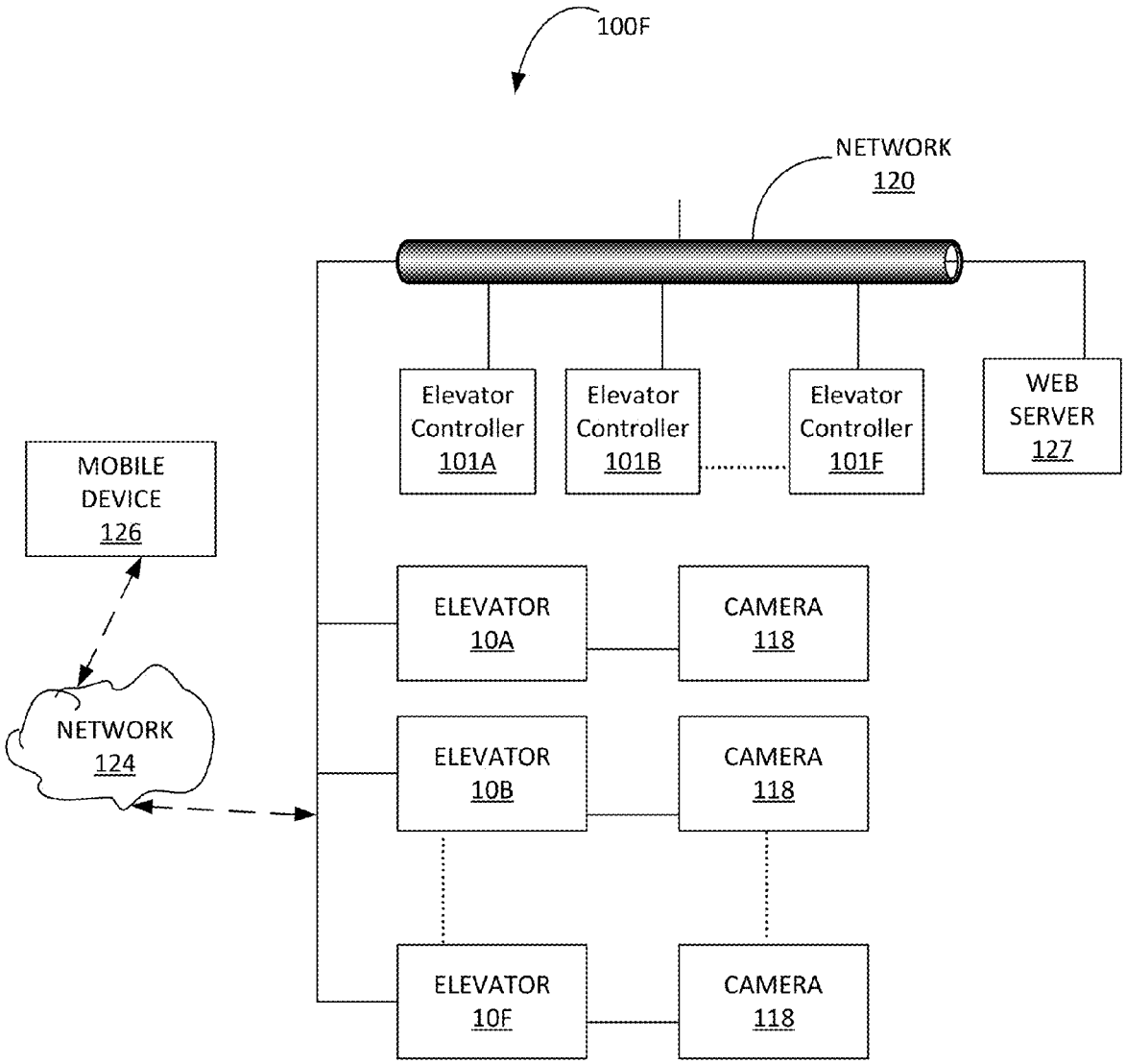

FIG. 4F shows yet another embodiment 100F of the elevator control system 100. The elevator control system 100F is similar to the elevator control system 100E in that at least one camera 118 is provided in each elevator kiosk 10A-10F which communicates with the elevator controllers 101A through 101F and the webserver 127 over the network 120. In the embodiment 100F, however, unlike the embodiment 100E and akin to the embodiment 100C, the user may wirelessly communicate over the network 124 (e.g., a Bluetooth network, an RFID network, et cetera) with the elevator kiosks 10A-10F directly.

The skilled artisan, upon reviewing FIGS. 4A through 4F, will thus readily appreciate that the elevator control system 100 may be configured in various ways, and that while the discussion below refers to the elevator control system 100, that the various concepts described are also applicable to the elevator control systems 100B through 100F.

Figure 5:
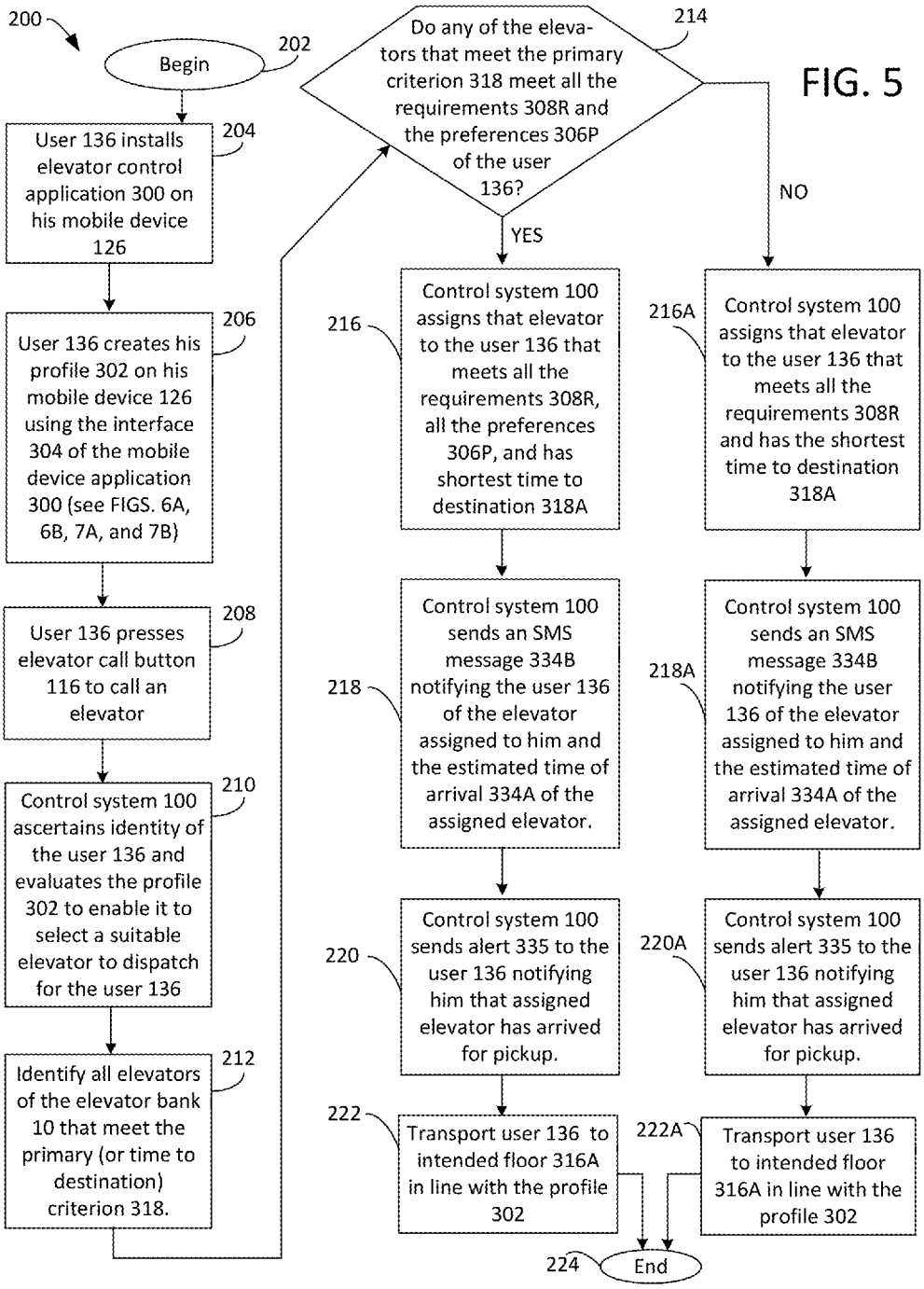
FIG. 5 is a flowchart illustrating a method of using the elevator control system, according to an embodiment.

Attention is directed now to FIG. 5, which shows a method 200 for allowing a user 136 to interact with the control system 100 via his mobile device 126 (e.g., smart phone, personal digital assistant, tablet computer, laptop computer, et cetera). Mobile devices 126 generally have one or more networking device that allows wireless communication over networks, such as over networks 120, 124. In line with the teachings of the present invention, users (such as a user 136) may be allowed to set their preferences regarding their elevator rides using their respective mobile devices, and the control system 100 may take these preferences into account in transporting these users via the elevators.

For the purposes of illustration, assume that the building 12 is an office building and that the user 136 works out of an office at the floor 12D of the building 12. While the method 200 is discussed with respect to a single user 136 and mobile device 126, the skilled artisan will readily appreciate that multiple (e.g., hundreds of thousands) users may similarly set their preferences using the method 200 via their respective mobile devices 126.

The method 200 may begin at step 202, and at step 204, the user 136 may install an elevator control application 300 on his mobile device 126. The elevator control application 300 may be a robust mobile application written using any suitable programming language (e.g., HTML, CSS, JavaScript, ActionScript) and installable on any mobile device (e.g., an Android® smart phone, an Apple® tablet, a Blackberry® personal digital assistant, et cetera). In some embodiments, the elevator control application 300 may be a free mobile application that may be downloaded over the web (e.g., at Google® Play, another application store, or via a dedicated or undedicated website such as the website 122), whereas in other embodiments, the elevator manufacturer may charge a fee for the user 136 to install and use the application 300.

At step 206, the user may create his user profile 302. The mobile application 300 may have an interface 304 to enable the user to create the profile 302. The interface 304 may also allow the user to set his preferences 306P and requirements 308R as part of his user profile 302. FIGS. 6A, 6B, 7A, and 7B show how the user 136 may create his profile 302 according to one exemplary embodiment.

Specifically, as shown in FIG. 6A, the elevator control application 300 may first cause a user identification page 304A to be displayed on the user's mobile device 126. The user identification page 304A may, for example, instruct the user 136 to enter his name 310, create a user name 312, enter the name of his employer 314, identify elevators to which the profile 302 of the user 136 is applicable, and optionally, enter a floor 316A (herein, the "intended floor") to which the user 136 usually takes the elevator to from a base floor 316B. The base floor 316B may be, for example, the ground floor, the first floor, or any other floor from which the user 136 generally boards the elevator after he enters the building 12, and the intended floor 316A may be, for example, the floor 12D where the office of the user 136 is located (or another floor where the user 136 generally takes an elevator to from the base floor 316B). If the building 12 had been a shopping mall, for example, the user 136 may have selected the intended floor 316A to be that floor where the user's favorite retail store is situated.

In some embodiments, the application 300 may also ask the user 136 to enter information that may be useful in identifying the mobile device 126. In other embodiments, the user 136 may be required only to enter his name, for example, and the application 300 may automatically fill the remaining information based on data obtained from third party sources (e.g., a database of the employer 314, a database of the elevator manufacturer, social media (e.g., the Facebook® or LinkedIn® profile of the user 136), et cetera).

For the purposes of illustration, assume that the user 136 fills out this information as shown in FIG. 6B. That is, assume that the name 310 of the user 136 is Joe Johnson, his user name 312 is Jjohnson, his employer's name 314 is Alpha Company, his intended floor 316A is floor 12D, the base floor 316B is floor 12A, the identification number of his mobile device 126 is AxF34, and that the user 136 wishes for his profile 302 to be applicable to the elevator bank 10. In some embodiments, the user 136 may be given the option to apply at least a part of his profile 302 to all elevators utilizing a control system compatible with the mobile application 300, or to create entirely different profiles for different elevator banks or for different buildings.

Once the user 136 has entered this information on the user identification page 304A, the elevator control application 300, to allow the user 136 to complete his profile 302, may display on the user's mobile device 126 a preferences and requirements page 304B (see FIG. 7A). The preferences and requirements page 304B may allow the user to enter several criteria 317 regarding the elevators he intends to use, and where suitable, further allow him to identify whether a particular criterion constitutes a preference 306P or a requirement 308R. For example, as shown in FIG. 7A, the preferences and requirements page 304B may allow a user to enter personalized information regarding one or more of a time to destination criterion 318, a passenger maximum criterion 320, a door open time criterion 322, an elevator notification method criterion 324, a fragrance allergy criterion 326, a friends criterion 330, a blocked user criterion 332, and an acceleration-deceleration criterion 333, each of which are discussed in more detail below.

The time to destination criterion 318 may allow the user 136 to set an upper bound for an amount of time (herein "time to destination") 318A within which the user 136 wishes to reach his intended floor 316A after he places a call for an elevator at the base floor 316B. This time to destination criterion 318 may also be referred to herein as the primary criterion 318. As discussed in more detail below, the control system 100, in determining which elevator to dispatch for the user 136 in response to an elevator call made by the user 136, may give most weight to the primary criterion 318. Assume, as shown in FIG. 7B, that the user selects his time to destination criterion 138 to be two minutes or less.

The passenger maximum criterion 320 may allow the user 136 to select the maximum number of passengers with which the user 136 wishes to ride an elevator with. For example, if the user 136 is claustrophobic, ochlophobic, or simply prefers not to ride crowded elevators, the user 136 may indicate that he does not wish to ride an elevator with any other passenger, or more than one other passenger, or more than two other passengers, et cetera. If the user 136 does not mind riding crowded elevators, he may also select that he has no passenger maximum criterion 320. The mobile application 300 may also allow the user 136 to select whether the passenger maximum criterion 320 is a preference 306P or a requirement 308R. As discussed in more detail below, the algorithm 100 may violate preferences 306P to ensure that the primary requirement 318 and the other requirements 308R are met. Assume, as shown in FIG. 7B, that the user 136 indicates that he does not want to ride an elevator with more than two other passengers, and that the meeting of the passenger maximum criterion 320 is a requirement 308R and not just a preference 306P.

The door open time criterion 322 may allow the user 136 to indicate whether he wishes to extend the time for which the door of an elevator opens to allow for ingress and egress of the user 136. For example, if the user 136 is disabled (e.g., is on a wheel chair, forced to walk slowly because of a temporary or permanent injury, et cetera), he may elect for the time for which the door of an elevator remains open to be extended to allow the user 136 to comfortably enter and/or exit the elevator. As with the passenger maximum criterion 320, the user 136 may further be allowed to indicate whether the meeting of the door open time criterion 322 is a preference 306P or a requirement 308R. Assume, as shown in FIG. 7B, that the user 136 wishes for the time for which the door of the elevator remains open to be extended, and further indicates that the meeting of the door open time criterion 322 is a requirement 308R. In some embodiments, the user 136 may be allowed to enter a specific time (e.g., 15 seconds, 30 seconds, et cetera) for which the user 136 wishes the door of an elevator to remain open to allow the user 136 to enter and/or exit the elevator.

When an elevator is assigned to an elevator call made by a user 136, an assignment alert 334, which includes identifying information for the assigned elevator, may be communicated wirelessly by the elevator control system to the mobile device 126 of the user and displayed by the application 300. In some embodiments, the assignment alert 334*a* may also include an estimated time of arrival. Such an assignment alert may ensure that the user 136 timely boards that elevator which has been dispatched by the control system 100 in response to an elevator call made by the user 136 (and not, for example, another elevator that also happens to be picking up passengers). The elevator notification method criterion 324 may allow the user 136 to indicate whether he wishes to also receive on his mobile device 126 an arrival alert 335 apprising the user 136 that the assigned elevator has arrived as requested by the user 136 (e.g., alert the user 136 that an elevator has arrived at the base floor 316B). The user 136 may further be allowed to select whether he wishes for the mobile device 126 to vibrate and/or make an audio announcement to convey one or more alerts (334, 335). This functionality may allow the user 136 to better utilize his time (e.g., to read a newspaper, to check his e-mail, et cetera) as he waits for the elevator to arrive. In some embodiments, the alert 335 may be (or also include) a Short Service Message ("SMS") 334B that identifies the elevator that the user 136 is to board, and optionally, conveys to the user 136 the estimated time of arrival 334B of that elevator. Assume, as shown in FIG. 7B, that the user 136 indicates that he wants his mobile device 136 to ring and vibrate to convey the alerts 334, 335, and also that the user 136 wishes to receive the SMS message 33B4 identifying the elevator that he is to board and apprising him of the estimated time of arrival 334A of that elevator.

Some people are allergic to one or more fragrances. Fragrance allergies may cause headaches, nausea, vomiting, sneezing, and/or general discomfort to those who come into contact with a fragrance to which they are allergic. In confined spaces, such as elevators, the discomfort caused by a particular fragrance to one who is allergic to that fragrance may be especially severe. The fragrance allergy criterion 326 may allow the user 136 to indicate whether he has a fragrance allergy 326A. If the user 136 does so indicate, the control system 100 may only dispatch that elevator for the user 136 in which all the other passengers also have fragrance allergies (or alternatively, an elevator with no other passengers). Assume, as shown in FIG. 7B, that the user 136 indicates that he does not have a fragrance allergies 326A.

The friends criterion 330 may allow the user 136 to indicate that he wishes to ride an elevator with one or more friends or coworkers. For example, the user 136 may wish to ride the elevator with other employees of the Alpha Company (i.e., other employees of the employer 314 of the user 136, see FIG. 6B). Alternatively, for example, the user 136 may wish to ride an elevator with certain specific individuals. The application 300 may allow the user 136 to enter individually the names or user names of people with whom he wishes to ride an elevator with, and also to select a group 137A of such individuals. The user 136 may also be allowed to indicate whether the friends criterion 330 is a requirement 308R or a preference 306P. In some embodiments, the controller may only consider listed names, user names, and employer names as a preference or requirement if another elevator call has the same friends criterion. Assume, as shown in FIG. 7B, that the user 136 indicates that he wishes to ride an elevator with a user 137 and also with any employee of the employer 314; and that the friends criterion 330 is a preference 306P. Had the user 136 indicated that the friends criterion 330 is a requirement 308R, the control system 100 may have ensured that an elevator transporting a passenger other than the user 137 and/or a member of the group 137A not be assigned to the user 136.

The blocked user criterion 332 may allow the user 136 to indicate whether he wishes not to ride an elevator with a certain individual or a group 137B of individuals. For example, if two competing business are located within the same building, the employees of one may wish to not ride an elevator with the employees of the other. Assume, for example, that the user 136 indicates that he does not wish to ride an elevator with a user 137C or with any employee of the Beta Company, a competing business 314B. Assume further that the user 136 indicates that the meeting of the blocked user criterion 332 is a requirement 308R.

The acceleration-deceleration criterion 333 may allow the user 136 to indicate whether he wishes for the elevators he rides to have standard acceleration and deceleration, or whether the user 136 wishes for the elevators he rides to have reduced acceleration and deceleration. As noted above, some people are unable to utilize elevators because they are made ill by rapid accelerations and decelerations. Such users may indicate via the acceleration-deceleration criterion 333 that they wish for their elevators to have reduced acceleration and deceleration, and may further be able to specify whether the acceleration-deceleration criterion 333 is a preference 306P or a requirement 308R. Assume, for example, that the user 136 is made ill by (or is uncomfortable with) rapidly accelerating and decelerating elevators, and indicates that it is a requirement 308R that his elevator have reduced acceleration and deceleration.

In this way, the user 136, via his mobile device 126 and the application 300, may be able to set various criteria 317 (e.g., the time to destination criterion 318, the passenger maximum criterion 320, the door open time criterion 322, the elevator notification method criterion 324, the fragrance allergy criterion 326, the elevator speed criterion 328, the friends criterion 330, the blocked user criterion 332, and the acceleration-deceleration criterion 333) regarding the elevator(s) he intends to use. The skilled artisan will appreciate that various criteria 317 outlined herein is exemplary only, and that in some embodiments, some of the criteria 317 identified herein may be omitted, and that in other embodiments, the user 136 may be allowed to select additional criteria 336 regarding his elevator rides. As one example, the user 136 may be allowed to indicate that he does not wish for his profile 302 to apply on the weekends, as shown in FIG. 7B. The profile 302 of the user 136, once it is created using the mobile device 126, may be transmitted over the network 120 (i.e., the World Wide Web) to the storage unit 104 automatically. In other embodiments, the profile 302 of the user 136 may be transmitted to the control system 100 over the network 124 (i.e., Bluetooth in this example) each time the user 136 is proximate the elevator bank 10, or each time the user 136 places a call for an elevator of the elevator bank 10.

Returning now to the method 200 at FIG. 5, once the user at step 206 has created his user profile 302, he may be ready to utilize the elevators in the elevator bank 10 in accordance therewith. The skilled artisan will appreciate that the profile 302 may be set by the user at any time (e.g., a minute, a day, a year) using the network 120 (i.e., the World Wide Web) before the next steps of the method 200 are performed. In some embodiments, the control system 100 may feed the application 300 to the mobile device 126 automatically (or alert the user 136 about the existence of the application 300) when the mobile device 126 is proximate the elevator bank 10.

At step 208, the user 136 may enter the building 12 (specifically the base floor 316B) and place a call for an elevator using the elevator call buttons 116. In other embodiments, the step 208 may be performed automatically; that is, once the user 136 is proximate the elevator bank 10, the application 300 may cause the mobile device 136 to automatically (and wirelessly) transmit an electronic message to the control system 100 over the network 124 indicating that the user 136 has placed a call for an elevator to the user's intended floor 316A. In other embodiments still, the user 136 may be allowed to manually place a call for an elevator via his mobile device 126, which may be wirelessly communicated to the control system 100. While not required, it is also contemplated that the user 136, in some embodiments, may be allowed to indicate the floor to which he wants to take the elevator to, particularly in cases where this floor is not the intended floor 316A.

Once the elevator call is made at step 208, at step 210, the control system 100 may ascertain the identity of the user 136 and evaluate the profile 302 of the user 136 to enable the control system 100 to select a suitable elevator to dispatch for the user 136. Where the elevator call is placed using the elevator call buttons 116, the control system 100 may determine that the elevator call has been placed by the user 136 in one of any number for ways. For example, once an elevator call is placed using the elevator call buttons 116, the control system 100 may poll the mobile devices proximate the elevator call buttons 116 over the network 124, and using the device identification number (or other identifying information) of the mobile device 126, ascertain that the call was placed by the user 136. In some embodiments, the control system 100 may utilize the camera 118 and accompanying facial recognition software to automatically determine the identity of the user 136. In other embodiments still, the elevator call buttons 116 may include biometric sensors (e.g., a thumb scanner) that allow the control system 100 to ascertain the identity of the user 136. Where the elevator call is automatically placed by the mobile device 126 wirelessly, information identifying the mobile device 126 of the user 136 may be encoded with the wireless elevator call.

To select a suitable elevator for the user 136, the control system 100 (and specifically the program 108) may at step 212 first identify all elevators of the elevator bank 10 that meet the primary (i.e., the time to destination) criterion 318. Assume, for example, that each of elevators 10A-10E can meet the primary criterion 318 (i.e., can pick up the user 136 and transport him to the intended floor 316A in two minutes or less), but that elevator 10F is currently scheduled to make multiple stops and would be unable to meet the primary criterion 318. The control system 100, thus, may no longer consider the elevator 10F in connection with the elevator call made by the user 136.

At step 214, the control system 100 may determine whether any of the elevators 10A-10E can meet each of the requirements 308R and also each of the preferences 306P set by the user 136 in his profile 302. If so, at step 216, the control system 100 may assign that elevator to the user 136 that has the shortest time to destination 318A. For example, if the elevators 10A and 10B meet each of the requirements 308R and each of the preferences 306P, and the time to destination 318A of elevators 10A and 10B is two minutes and one minute, respectively, the control system 100 may assign the elevator 10B to the user 136. Then, at step 218, the control system 100 may wirelessly transmit (using, for example, the networking device 114) the SMS (or another suitable type of) message 334B notifying the user 136 that the elevator 10B has been assigned to the user 136 and the estimated time of arrival 334A of the elevator 10B. This notification may be displayed by the mobile device 126. At step 220, once the assigned elevator 10B reaches the base floor 316B, the control system 100 may transmit the alert 335 to the mobile device 126, which may vibrate and ring in line with the profile 302 of the user 136 to apprise him that the elevator has reached the base floor 316 to pick up the user 136. At step 222, the user 136 may board the assigned elevator and be transported to the intended floor 316A in line with the profile 302. The method 200 may then end at step 224.

Alternatively, if at step 214 the control system 100 had determined that no elevator meets all the preferences 306P of the user 136, the control system 100 may at step 216A assign that elevator to the user 136 which meets all the requirements 308R of the user 136 and has the shortest time to destination 318A. For example, if no elevator 10A-10E could meet the preferences 306P of the user, only elevators 10C and 10D could meet all the requirements 308R, and the time to destination of elevators 10C and 10D is thirty seconds and one minute, respectively, the control system 100 may assign the elevator 10C to the user 136. Had the time to destination 318A of the elevators 10C and 10D been within a threshold (e.g., within two seconds, five seconds, ten seconds, et cetera), the control system 100 may optionally have assigned that elevator to the user 136 which met more of the preferences 306P of the user 136. Then, at step 218A, the control system 100 may transmit the SMS message 334B notifying the user 136 that the elevator 10C had been assigned to the user 136 and its estimated time of arrival 334A. At step 220A, when the assigned elevator 10C reaches the base floor 316B, the control system 100 may transmit the alert 34 to the mobile device 126 to apprise the user 136 that the elevator 10C has reached the base floor to pick up the user 136. The user may then be transported to the intended floor 316A in accordance with the profile 302 at step 222A, and the method may then end at step 224.

Thus, as has been described, the control system 100 may allow users (e.g., the user 136) to affect the assignment and operation of elevators to better suit their needs. The skilled artisan will appreciate that the concepts disclosed herein may also be applied to only some elevators within an elevator bank. For example, the control system 100 may consider the profile 302 of the user 136 only in responding to calls for elevators 10A-10C, and may assign and operate the remaining elevators 10D-10F according to the prior art elevator control algorithms 16A. The skilled artisan will also appreciate that some or all of the user criteria 317 may be dynamically implemented. For example, in some embodiments, some elevators may be configured to always accelerate and decelerate at a reduced rate, whereas in other embodiments, the control system 100 may dynamically reduce the acceleration and deceleration of an elevator to satisfy the acceleration-deceleration criterion 333 of a user.

Further, in some embodiments, at least some of the criteria 317 discussed herein may be selected by the application 300 automatically on behalf of the user 136. For example, in some embodiments, the application 300 may automatically determine the time to destination criterion 318 depending on statistical data, and/or operational parameters and efficiency. Similarly, in some embodiments, the application may automatically determine (instead of the user 136) whether a particular criterion is a preference 306P or a requirement 308R. Such a determination may be based on an elevator bank to elevator bank basis, or on a building to building basis, for example. In still other embodiments, the application may require authorization to accept a particular preference 306P or requirement 308R. Such an authorization may be in the form of a pin provided by building management or an employer, for example. Should an elevator bank be incapable of meeting all of a user's requirements, the application 300 may inform the user that his or her requirements cannot be met and may give the user the option to cancel his call request.

While not expressly shown in the figures, the application 300 may also allow the user 136 to indicate that he is a VIP (e.g., the chief executive officer of the Alpha Company). If the user 136 indicates that he is a VIP, the control system 100 may give preference to an elevator call made by the user 136 over all the other pending elevator calls. Numerous other such variations may be made to the program 108 to allow the control system 100 to better meet the requirements of a particular application.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. An elevator control system for controlling a plurality of elevators in an elevator bank, comprising:

a processor in communication with a non-transitory memory; and software instructions that, when executed by the processor, perform steps for:

receiving an elevator call placed by at least one of a user and a mobile device of the user;

wirelessly communicating with the mobile device to determine an elevator criteria set by the user, the elevator criteria comprising a requirement and a preference;

identifying from the plurality of elevators in the elevator bank, at least one elevator that meets the requirement while considering the preference;

assigning an elevator to the user from the at least one elevator identified that meets at least the requirement; and wirelessly communicating an alert to the mobile device to notify the user of a status of the assigned elevator.

2. The elevator control system of claim 1 wherein the elevator criteria set by the user includes selecting the requirement and the preference from a group consisting of:

a time to destination criterion allowing the user to determine if the shortest time to destination is at least one of a requirement and a preference;

a door open time criterion allowing the user to determine a length of time an elevator door is opened;

an acceleration-deceleration criterion allowing the user to modify the acceleration of the assigned elevator;

a friends criterion allowing the user to ride or not ride an elevator with at least one of a certain individual and a group of individuals; and a passenger maximum criterion allowing the user to determine the amount of passengers that the user is willing to ride with.

3. The elevator control system of claim 1, wherein the assigned elevator that meets the requirement is at least one of: (i) an elevator that also meets the the preference; and (ii) an elevator that also has a time to destination that is shorter than a time to destination of all other identified elevators in the elevator bank that meet the requirement.

4. The elevator control system of claim 1, wherein the mobile device automatically places the elevator call when the mobile device is proximate the elevator bank.

5. The elevator control system of claim 1, wherein the alert is communicated to the mobile device when the assigned elevator reaches a floor from which the elevator call is placed.

6. The elevator control system of claim 1, wherein a message notifying the user of an estimated time of arrival of the assigned elevator is wirelessly transmitted to the mobile device prior to the alert.

7. The elevator control system of claim 1, wherein an acceleration and a deceleration of the assigned elevator is adaptively modified in response to at least one of the requirement and the preference set by the user.

8. The elevator control system of claim 1, wherein the elevator criteria set by the user includes each of:

a time to destination criterion allowing the user to determine if the shortest time to destination is at least one of a requirement and a preference;

a door open time criterion allowing the user to determine a length of time an elevator door is opened;

an acceleration-deceleration criterion allowing the user to modify the acceleration of the assigned elevator;

a friends criterion allowing the user to ride or not ride an elevator with at least one of a certain individual and a group of individuals; and a passenger maximum criterion allowing the user to determine the amount of passengers that the user is willing to ride with.

9. The elevator control system of claim 1, wherein the elevator criteria set by the user includes a fragrance allergy criterion, which allows the user to indicate if they have a fragrance allergy.

10. The elevator control system of claim 1, wherein the requirement is that the assigned elevator has no other passengers.

11. The elevator control system of claim 1 further comprising a camera; and wherein the software instructions further perform the step of ascertaining an identity of the user using data from the camera.

12. An elevator control system for controlling a plurality of elevators in an elevator bank, comprising:

a processor in communication with a non-transitory memory;

a networking device; and software instructions that, when executed by the processor, perform steps for:

receiving an elevator call placed by at least one of a user and a mobile device of the user;

wirelessly communicating with the mobile device to determine an elevator criteria set by the user on the mobile device using an elevator control application the elevator criteria comprising a requirement and a preference;

identifying from the plurality of elevators in the elevator bank, at least one elevator that meets the requirement while considering the preference; and assigning an elevator to the user from the at least one elevator identified.

13. The elevator control system of claim 12 wherein the software instructions further perform the step of using the networking device to wirelessly communicate an alert to the mobile device to apprise the user of a status of the assigned elevator.

14. The elevator control system of claim 12, wherein:

the elevator criteria set by the user includes selecting the requirement and the preference from a group consisting of:

a time to destination criterion allowing the user to determine if the shortest time to destination is at least one of a requirement and a preference;

a door open time criterion allowing the user to determine a length of time an elevator door is opened;

an acceleration-deceleration criterion allowing the user to modify the acceleration of the assigned elevator;

a friends criterion allowing the user to ride or not ride an elevator with at least one of a certain individual and a group of individuals; and a passenger maximum criterion allowing the user to determine the amount of passengers that the user is willing to ride with; and the mobile device is a smart phone.

15. The elevator control system of claim 12 wherein the elevator control system adaptively modifies an operation of the assigned elevator to meet the elevator criteria.

16. An elevator control system for operating a first elevator and a second elevator, comprising:

a processor in communication with a non-transitory memory and a networking device; and software instructions that, when executed by the processor, perform steps for:

receiving an elevator call placed by at least one of a user and a mobile device of the user;

wirelessly communicating with the mobile device over a network to determine an elevator criteria set by the user; the elevator criteria comprising a requirement and a preference;

identifying from the plurality of elevators in the elevator bank, at least one elevator that meets the requirement and the preference; and determining that more than one elevator meets both the requirement and the preference;

assigning an elevator from the at least one elevator identified to the user that has a shortest time to destination.

17. The elevator control system of claim 16, wherein the software instructions further perform the step of notifying the user of an estimated time of arrival of the assigned elevator.

18. The elevator control system of claim 16, wherein a door open time of an elevator is extended to meet the elevator criteria.

19. The elevator control system of claim 16, wherein the assigned elevator is not assigned to a second user while it is assigned to the user if the elevator criteria indicates that the second user is on a blocked list of the user.

20. The elevator control system of claim 16, wherein the mobile device is a cellular phone and the network device is a cellular network.

21. The elevator control system of claim 14, wherein:

the elevator criteria set by the user includes selecting a second requirement and a second preference from a group consisting of:

a time to destination criterion allowing the user to determine if the shortest time to destination is at least one of a requirement and a preference;

a door open time criterion allowing the user to determine a length of time an elevator door is opened;

an acceleration-deceleration criterion allowing the user to modify the acceleration of the assigned elevator;

a friends criterion allowing the user to ride or not ride an elevator with at least one of a certain individual and a group of individuals; and a passenger maximum criterion allowing the user to determine the amount of passengers that the user is willing to ride with.

22. The elevator control system of claim 2, wherein:

the elevator criteria set by the user includes selecting a second requirement and a second preference from a group consisting of:

a time to destination criterion allowing the user to determine if the shortest time to destination is at least one of a requirement and a preference;

a door open time criterion allowing the user to determine a length of time an elevator door is opened;

an acceleration-deceleration criterion allowing the user to modify the acceleration of the assigned elevator;

a friends criterion allowing the user to ride or not ride an elevator with at least one of a certain individual and a group of individuals; and a passenger maximum criterion allowing the user to determine the amount of passengers that the user is willing to ride with.

* * * * *